United States Patent [19]

Strenkert

[11] 4,278,418

[45] Jul. 14, 1981

[54] PROCESS AND APPARATUS FOR STOICHIOMETRIC COMBUSTION OF FUEL OIL

[76] Inventor: Lynn A. Strenkert, 16 Azalea La., Wilton, Conn. 06897

[21] Appl. No.: 69,362

[22] Filed: Aug. 24, 1979

Related U.S. Application Data

[63] Continuation of Ser. No. 640,978, Dec. 15, 1975, abandoned.

[51] Int. Cl.[3] ..... F23C 5/00

[52] U.S. Cl. ..... 431/8; 239/422; 239/424.5; 239/428; 431/353

[58] Field of Search ..... 239/422, 423, 424, 424.5, 239/428; 431/8, 10, 352, 353

[56] References Cited

U.S. PATENT DOCUMENTS

| | | | |
|---|---|---|---|
| 901,788 | 10/1908 | Damon . | |
| 1,458,378 | 6/1923 | Astrom . | |
| 1,841,169 | 1/1932 | Butz . | |
| 2,143,958 | 1/1939 | Pontius, Jr. . | |
| 2,259,011 | 10/1941 | Taylor | 299/130 |
| 2,530,617 | 11/1950 | Kirk et al. . | |
| 2,569,754 | 10/1951 | Gressley . | |
| 2,613,737 | 10/1952 | Schwietert . | |
| 2,643,916 | 6/1953 | White et al. | 299/141 |
| 2,839,128 | 6/1958 | Schweitzer et al. . | |
| 2,861,628 | 11/1958 | Fraser . | |
| 3,042,105 | 6/1962 | Bitterlich . | |
| 3,062,273 | 11/1962 | Colin-Smith | 239/422 X |
| 3,078,047 | 2/1963 | Enemark | 239/103 |
| 3,091,283 | 5/1963 | Kidwell . | |
| 3,150,708 | 9/1964 | Davis, Sr. et al. . | |
| 3,203,769 | 8/1965 | Sogawa et al. | 23/277 |
| 3,245,457 | 4/1966 | Smith et al. | 431/352 X |
| 3,254,846 | 6/1966 | Schreter et al. | 239/400 |
| 3,302,686 | 2/1967 | Hewlett, Jr. . | |
| 3,310,240 | 3/1967 | Grundman | 239/422 X |
| 3,360,201 | 12/1967 | Popyk | 239/422 X |
| 3,361,183 | 2/1968 | Reichhelm . | |
| 3,362,647 | 1/1968 | Davis, Sr. et al. | 239/404 |
| 3,490,230 | 1/1970 | Pillsbury et al. | 60/39.65 |
| 3,705,784 | 12/1972 | Reihhelm | 431/116 |
| 3,741,483 | 6/1973 | Kawaguchi | 239/400 |
| 3,764,069 | 10/1973 | Runstadler et al. | 239/8 |
| 3,831,854 | 8/1974 | Sato et al. | 431/352 X |
| 3,870,456 | 3/1975 | Graat | 431/8 |
| 3,980,233 | 9/1976 | Simmons et al. | 239/422 X |

*Primary Examiner*—Edward G. Favors

*Attorney, Agent, or Firm*—St. Onge, Steward, Johnston, Reens & Noë

[57] ABSTRACT

A process and apparatus for the combustion of liquid fuel provides an extremely intense blue/violet flame having a temperature in excess of 3000° F. with combustion under near perfect stoichiometric conditions without the formation of soot. The liquid fuel is atomized and mixed with air within a nozzle and enters a flame tube surrounding the nozzle as a conical stream where it is further atomized by jets of air directed to converge on the stream and mixed with secondary combustion air to obtain the desired combustion mixture. Yet further atomization of the liquid fuel-air mixtures within the flame tube can be obtained as a consequence of at least partial vaporization of the liquid fuel therein through the heat of the flame tube. An advantageous relationship exists between the size, angle and point of convergence of the air jets with the atomized conical stream, the flame tube diameter and length and the location of the nozzle therein and the fuel feed.

22 Claims, 20 Drawing Figures

PROCESS AND APPARATUS FOR STOICHIOMETRIC COMBUSTION OF FUEL OIL

This application is a continuation of copending application Ser. No. 640,978 filed Dec. 15, 1975 abandoned.

BACKGROUND OF THE INVENTION

The present invention relates to a process and apparatus for the combustion of liquid fuels, especially fuel oil Numbers 2 through 4. Further, the present invention relates more particularly to an oil atomizing burner that uses low pressure air as the primary and secondary atomizing medium.

There are known combustion processes and burners by which fuel oils are atomized with air. Prior art burners are not adapted to produce perfect or near perfect combustion. As a result, soot and carbon are formed which has a further detrimental effect on the burner operation as the soot and carbon contaminate the nozzle, combustion chamber and other heat-exchange surfaces. The present invention, by producing complete combustion, eliminates the formation of soot.

One of the more advanced designs for burners prior to the present invention is shown in U.S. Pat. No. 3,362,647 to Davis et al. That patent discloses a burner spray nozzle which utilizes fuel oil under pressure which is thereafter mixed with normally aspirated air. In the present invention, the atomized air is under pressure and the fuel is not. These are burners which do, however, utilize low pressure air for atomization purposes as well as to draw the fuel into the mixing chamber. Such a design is shown in Schreter et al, U.S. Pat. No. 3,254,846. The Schreter patent does not utilize the construction of the present nozzle which has been designed to swirl the fuel-air mixture to increase the atomization process. Further Schreter does not disclose the use of a flame tube or secondary atomization which is utilized by the present invention. Another prior art construction which is of possible interest is disclosed by Graat, U.S. Pat. No. 3,870,456. This prior art reference does not disclose the present invention as it utilizes an entirely different nozzle structure wherein the fuel is under pressure. Further, the Graat reference does not disclose any secondary or tertiary atomization.

The burners disclosed in the above references are similarly deficient when contrasted to the present invention, that is, they do not produce an extremely intense, short-length flame. Further, the present invention is 30% to 40% more efficient than conventional burners. These advantages are the result of combining the flame or mixing tube with secondary and even tertiary atomization, to produce a violet flame with temperatures in excess of 3000° F. without preheating air and/or fuel. Further, the temperature of the flame can be precisely controlled over a complete range while maintaining complete combustion.

SUMMARY OF THE INVENTION

The present invention provides a fuel oil burner which is extremely efficient in its burning operation. This efficiency is the result of the sub-micron particle size into which the fuel oil is atomized, and precise control of the fuel-air ratio. In the present invention, the fuel is atomized in at least three stages: (1) the fuel is pre-atomized within the nozzle; (2) the fuel having been atomized is further atomized by air jets which cause the mixture existing from the nozzle to be further reduced in size; specifically, the droplets in the present invention are from one-fifth to one-tenth the size of oil droplets that are the product of conventional atomization techniques; and (3) the heat of the mixing tube surrounding the nozzle further atomizes the sub-micron oil droplets by vaporization of the finely atomized particles of oil.

One important aspect of the invention is that the atomization is accomplished by a very small volume of air that is under moderate pressure. The atomizing air provides both suction to lift the fuel oil into the nozzle and the energy to pre-atomize the fuel within the nozzle. Further, an air jet from the air source is injected into the mixture of atomized fuel and air to create secondary atomization The mixing chamber controls the amount of combustion air that is introduced into the area surrounding the flame and thus controls the stoichiometric mixture of the fuel oil and air.

Accordingly, it is an object of this invention to provide a device for the combustion of liquid fuels which operate at near perfect combustion conditions without the production of soot.

It is a further object of this invention to provide a device which produces a high heat release blue/violet flame having an intense temperature of over 3000° F. without the use of pre-heated air. A further object of this invention is that the high heat release flame is produced by moderate pressure air which can be easily provided at a low cost.

An additional object of this invention is to provide a burner that very finely atomizes a variety of fuel oils for better combustion. Another object of this invention is to provide a burner that produces an extremely intense, but yet short flame.

A further object is to provide a burner of simple construction which can be economically manufactured and operated with a minimal amount of maintenance.

These and other objects and advantages of the present invention will be more readily apparent from the following detailed description of the drawings illustrating the preferred embodiment of the invention.

DESCRIPTION OF THE PREFERRED EMBODIMENTS

Figure 1:
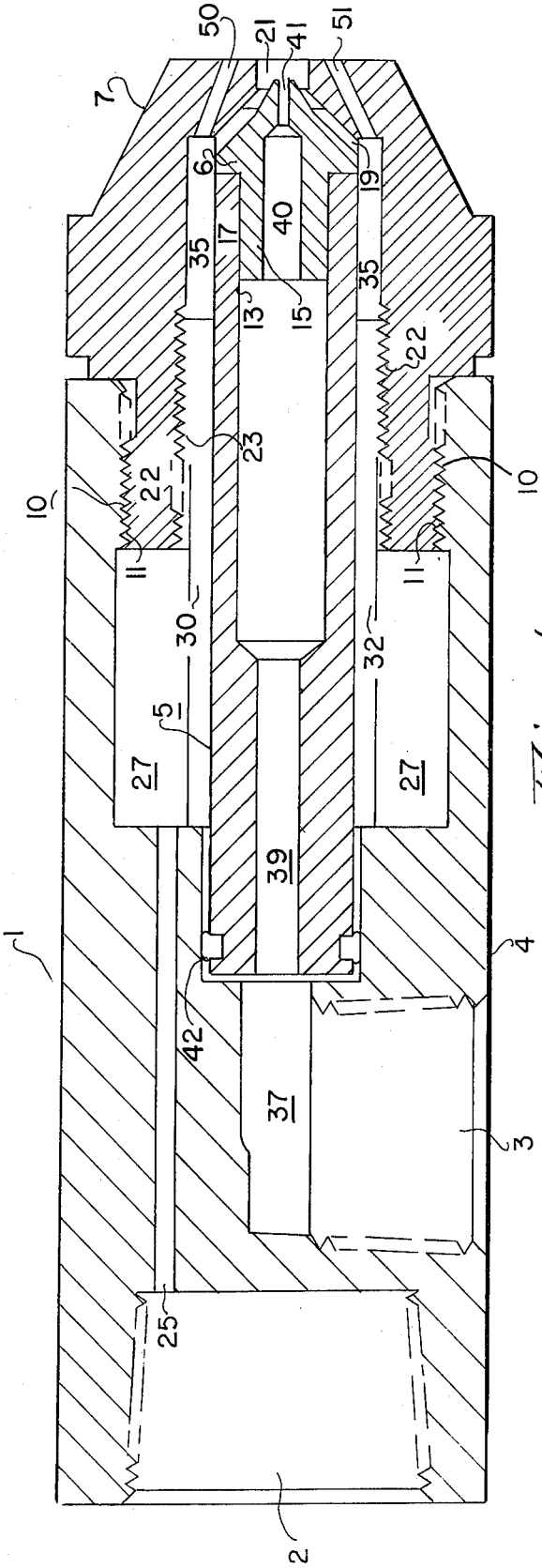
FIG. 1 is a sectional view of the nozzle utilized by the present invention.

FIG. 1 shows the nozzle 1 utilized by the present invention. Nozzle 1 has orifice 2 which is connected to a source of compressed air and an orifice 3 which is connected to a source of fuel oil. The nozzle assembly includes the nozzle body 4, the oil suction stem 5, and convoluted impeller 6 and nozzle front piece 7.

The forward portion of the nozzle body 4 includes a threaded female coupling 10 into which mounts and is held the nozzle front piece 7. Correspondingly, the nozzle front piece 7 at its rearward portion includes a threaded male coupling 11.

Figure 2:
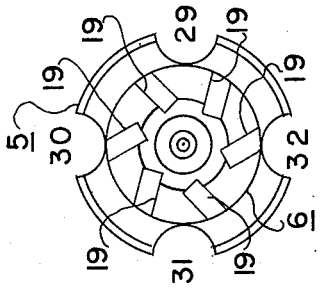
FIG. 2 is a frontal view of the convoluted impeller and nozzle of the present invention.

The oil suction stem 5 and the convoluted impeller 6 are arranged so that the orifice 13 on the forward end of the oil suction stem is adapted to accept the stem portion 15 of the convoluted impeller 6. The impeller 6 is seated against elongated section 17 of the oil suction stem. A front view of the impeller in combination with the oil suction stem 5 is shown in FIG. 2. As shown, the impeller includes a series of slots 19 which are designed to change the direction of the air as well as to give the air a spiral effect when it reaches the atomizing area 21. The combination of the oil suction stem 5, the convoluted impeller 6 and the nozzle front piece 7 are compressively held together by the internal threads 22 of the front piece 7 and the threads 23 on the oil suction stem.

Figure 3:
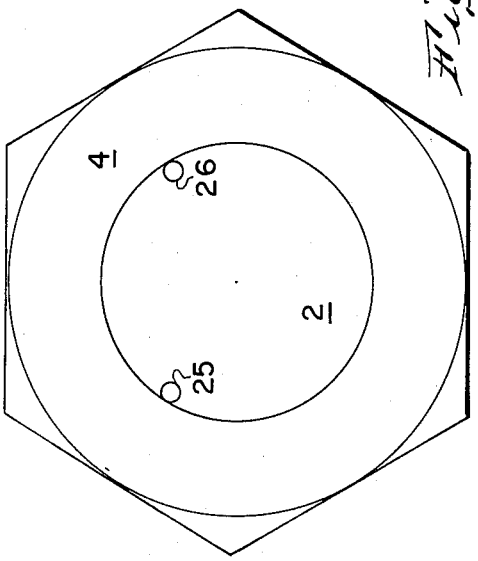
FIG. 3 is the left side or rear of the nozzle structure of FIG. 1.

Compressed air is admitted at orifice 2 and passes through air passages 25 and 26 to rear-air chamber 27 which is created by the annularly shaped space between the nozzle body 4, the nozzle front piece 7 and the oil suction stem 5. The air passages are shown in FIG. 3 which is the left side view of the nozzle in FIG. 1. Fluting 29, 30, 31 and 32 on the oil suction stem 5 interconnects the rear air chamber 27 to the forward air chamber 35. Middle air chamber 35 is created by the annularly shaped space between the oil suction stem 5, the convoluted impeller 6 and the nozzle front piece 7. From the forward air chamber the compressed air reaches the atomizing area 21 through slots 19 in the convoluted impeller.

Fuel oil is admitted at orifice 3 and passes through conduit 37 to and through conduit 39 located in the oil suction stem 5. The convoluted impeller 6 contains oil passage 40 and nozzle passage 41 to permit the oil entering orifice 3 to be in communication with the atomizing area 21. As shown in the embodiment of FIG. 1, O-ring 42 precludes the possibility that oil and compressed air will intermingle with one another in the nozzle body.

In operation, compressed air is introduced at orifice 2 of the nozzle. Passing through air passages 25 and 26 to the rear air chamber 27. Thereafter, the compressed air passes from the annularly shaped air chamber 27, through flutings 29, 30, 31 and 32 to the forward air chamber 35. The fluting on the oil suction stem 5 imparts a generally linear direction to the air which is abruptly ended when it arrives at the convoluted impeller. The air when it passes over the impeller 6 through slots 19 is both deflected in a converging manner toward the atomization area 21 and because the slots 19 are off-center, is given a spiral or vortex-like motion. By being forced through the small passages 19, the air velocity is increased, causing a partial vacuum to exist in the atomizing area 21. This partial vacuum will cause suction by which the fuel oil can be pulled through the nozzle 41. Also, the air has a vortex-like motion which provides the primary atomization medium to break or pre-atomize the liquid fuel to micron size droplets. Thus, the present nozzle is constructed so that the flow of compressed air through the nozzle provides both the suction to lift the fuel through the nozzle as well as the means by which the mixture of air and fuel are pre-atomized within the nozzle. Further, the compressed air provides a source of oxygen for the combustion of the mixture.

As the mixture of air and oil droplets of micron size leave the primary atomization area 21, it leaves in an extending conically shaped air stream. The present invention provides for secondary atomization to take place once the mixture leaves the nozzle. Secondary atomization is accomplished by air jets, from the nozzle front piece 7 which intersect with the mixture as it leaves the nozzle in an extending conically shaped air stream. As shown in FIG. 1, air jets 50 and 51 are arranged so that they direct air which converges upon the pre-atomized mixture leaving the nozzle. The introduction of this air into the conically shaped air stream causes further turbulence and results in producing an oil droplet size five to ten times smaller than conventional atomizers.

Figure 4:
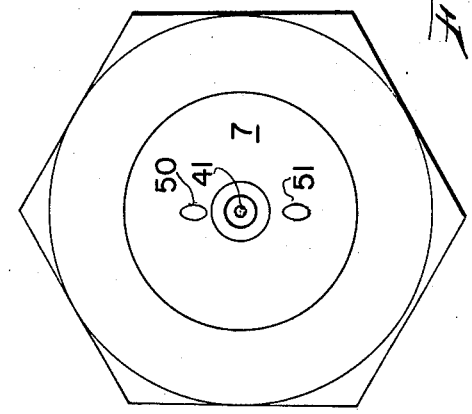
FIG. 4 is the front portion of the nozzle structure of FIG. 1, with four air jets.
Figure 5:
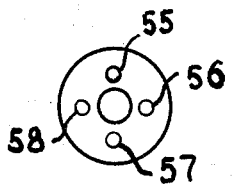
FIG. 5 is the front portion of the nozzle structure of FIG. 1 with four air jets.
Figure 6:
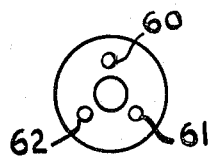
FIG. 6 is the front portion of the nozzle structure of FIG. 1, with three air jets.
Figure 7:
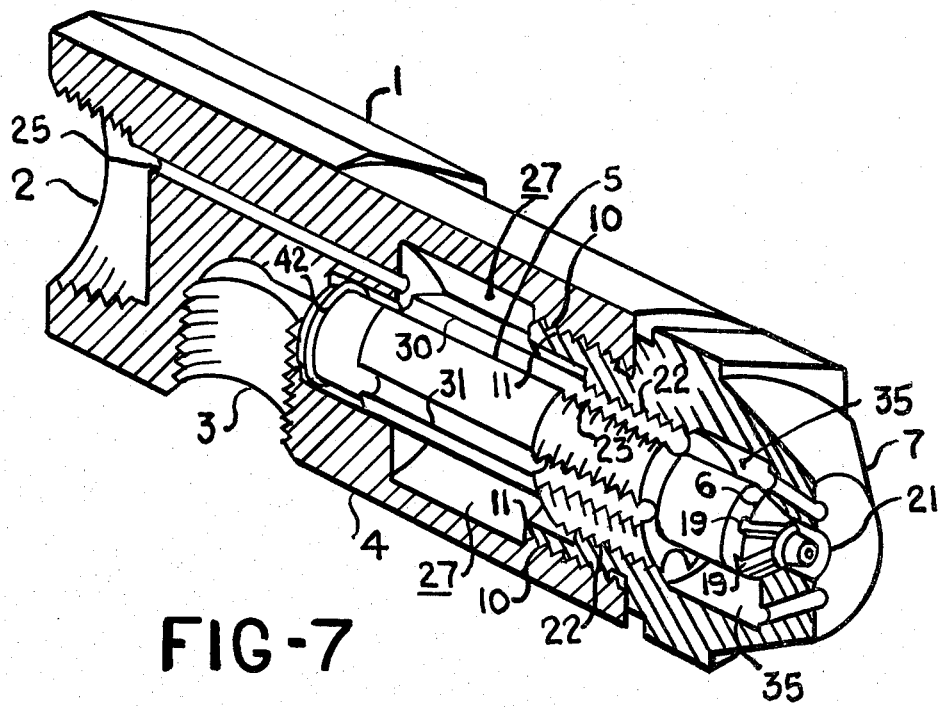
FIG. 7 is a perspective, sectionalized view of the nozzle structure of FIG. 1.
Figure 8:
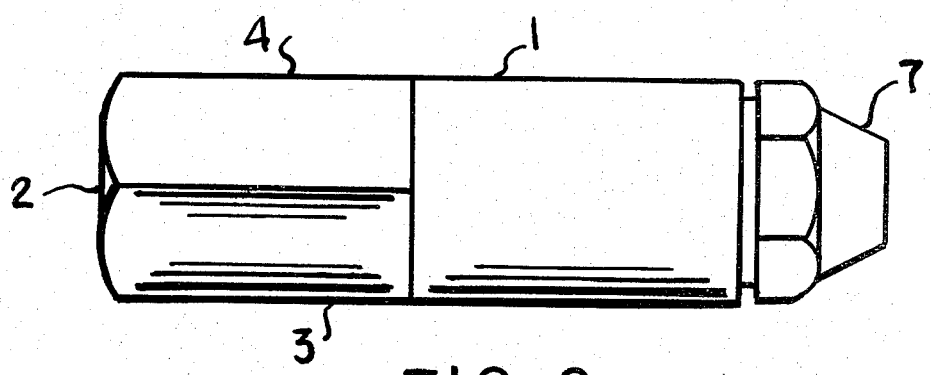
FIG. 8 is a side view of the nozzle structure of FIG. 1.

As is shown in FIGS. 1 and 4, air jets 50 and 51 obtain their source of air from forward air chamber 35 and convergingly direct that air into the conically shaped air stream. It is, of course, possible to have more than two air jets. Four air jets 55, 56, 57 and 58 are shown in FIG. 5 and three air jets 60, 61 and 62 shown in FIG. 6.

In the table below, there is a representation in accordance with the capacity of the burner in gallons per hours of the following: the angle A that is made between the axis of the air jet and the longitudinal axis of the nozzle; the diameter of the air jets; and the distance from the nozzle to the point of convergence of the air jets. It is understood that these are the dimensions that at the present time have produced the best results and it is not intended that this invention will be limited in any manner to the below-specified dimensions.

| Capacity (Gallons per hour) | Angle A | Hole Diameter | Point of Convergence |
|---|---|---|---|
| .2 | .7° | .031" | 1" |
| .5 | 4.5° | .031" | 1.22" to 1.5" |
| 1.0 | 3.5° | .035" | 1.66" to 1.75" |

In the present invention, the nozzle is mounted within a flame tube to produce extremely advantageous results. By mounting the nozzle within a flame tube, it is possible to provide for the combustion of fuel oils under near perfect conditions without soot. The combustion of flame tube and nozzle produces an extremely intense blue/violet flame having an operating temperature between 3000° F. and 3200° F. without the use of preheated air.

Figure 12:
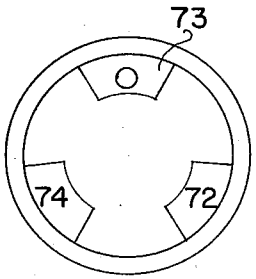
FIG. 12 is a frontal view of flame tube shown in FIG. 10.
Figure 11:
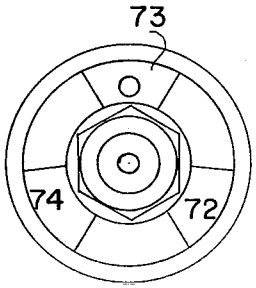
FIG. 11 is the front view of the flame tube shown in FIG. 9.
Figure 10:
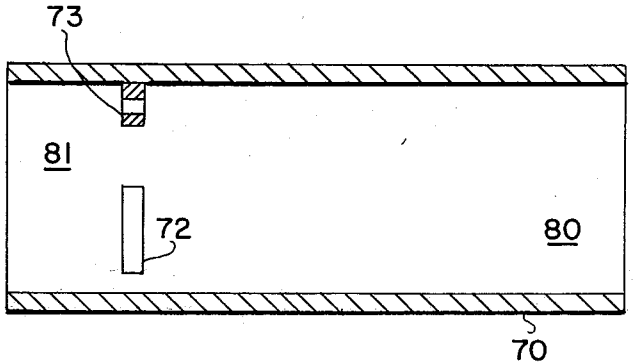
FIG. 10 is the flame tube of FIG. 9 with the nozzle structure removed.
Figure 9:
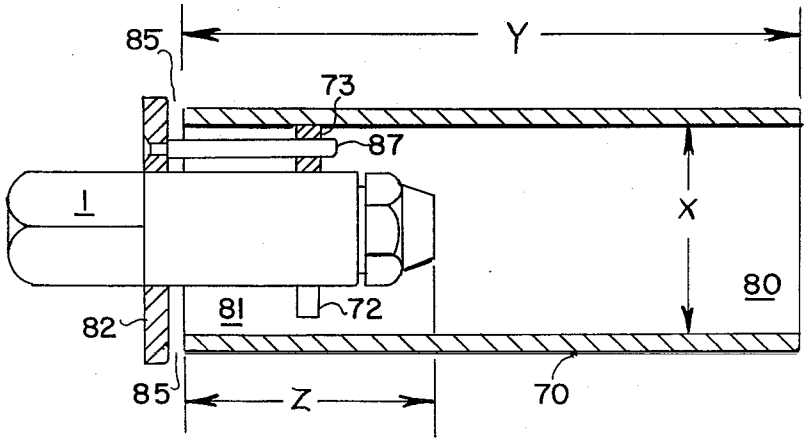
FIG. 9 is a partially sectioned view of flame tube and nozzle structure utilized by the present invention.

One embodiment of the flame tube is shown in FIGS. 9 and 10. In flame tube 70 is mounted nozzle 1. The nozzle 1 is held within the flame tube 70 by a series of mounting blocks 72, 73 and 74, spaced equidistant from one another as shown in FIGS. 11 and 12. The nozzle is held in place on the mounting blocks by conventional means such as set screws or other fastening means known to those skilled in the art. The forward end 80 of flame tube 70 is open and is the location from which the intense blue/violet flame emerges. The rear portion 81 of the flame tube 70 is enclosed by collar 82. Collar 82 is arranged so that depending upon its distance from the rearmost portion of tube 70, it will create an air gap, 85. By moving collar 82 back and forth with respect to the end of tube 70, the air gap and the quantity of air for combustion can be controlled. This particular configuration is particularly advantageous in that it permits air to come in around the periphery of the flame tube to permit a more even mixture of the air for combustion with the atomized mixture flowing from the nozzle. The air from the atmosphere entering the flame tube 70 is referred to as secondary air.

The particular configuration shown in FIGS. 9 to 14 has the additional advantage that air entering the periphery of the flame tube provides a cooling effect for the nozzle assembly. In operation, the unit is sufficiently cool that it can be touched by a person without burning the hand. This eliminates the problem of oil carbonization in the nozzle with consequent plugging and maintenance.

In the table below, there is represented in accordance with the fuel burning capacity of the burner, the inside diameter of the flame tube (X); the length of the flame tube (Y); and the depth of the nozzle in the flame tube (Z). Again, these are the dimensions which to date have produced the best results and are not intended in any manner to limit the scope of the invention.

| Volume (Gallons per hour) | Inside Diameter X | Length Y | Depth of Nozzle Z |
|---|---|---|---|
| .2 | $1\frac{1}{8}$" | 4" | $2\frac{5}{8}$" |
| .5 | $1\frac{3}{8}$" | 4.43" | $2\frac{5}{8}$" |
| 1.0 | $1\frac{5}{8}$" | 5" | $3\frac{5}{8}$" |

Further, in the table below are represented the distance D between the collar and the rear portion of the flame tube and the air pressure used for the air used for primary atomization.

| Volume (Gallons per hour) | Distance D | Air Pressure PSIG |
|---|---|---|
| .2 | 3/32" | 10–20 |
| .5 | 1/16" to 3/32" | 15–30 |
| 1.0 | 3/32" to 5/32" | 50 |

As is shown in FIG. 9, collar 82 is free to move over the nozzle which is fixedly mounted within the flame tube. Once the correct mixture has been found, then the collar 82 is rigidly held in place by rod 87 which is connected to collar 82 and passes through mounting block 73. Again, a set screw or other fastening means is used to hold the assembly rigidly together once the proper distance between the rear of the flame tube and the collar has been found.

Figure 14:
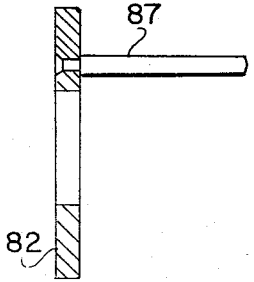
FIGS. 13 and 14 illustrate the control collar used in conjunction with the flame tube of FIG. 9.
Figure 13:
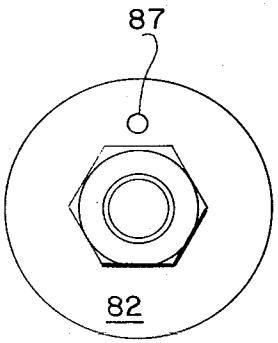

FIGS. 9, 11 and 13 show the same flame tube as FIGS. 10, 12 and 14, except that in the latter, the nozzle has been removed to more clearly illustrate the construction of the flame tube. It should be noted that approximately 80% of the combustion air is obtained from the air intakes on the flame tube. The remaining 10% is the primary air or the air utilized to provide primary atomization.

Figure 15:
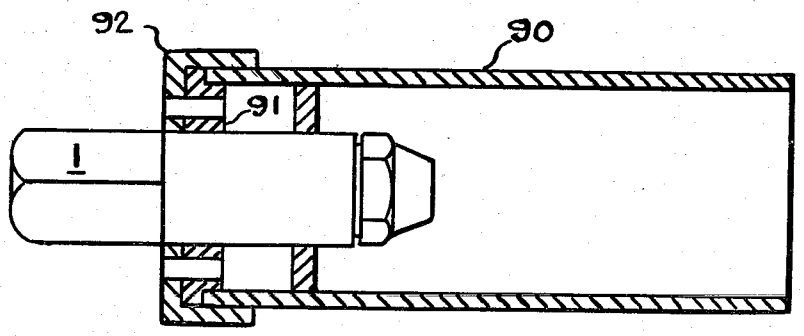
FIG. 15 is a second embodiment of the flame tube and nozzle structure utilized by the present invention.
Figure 16:
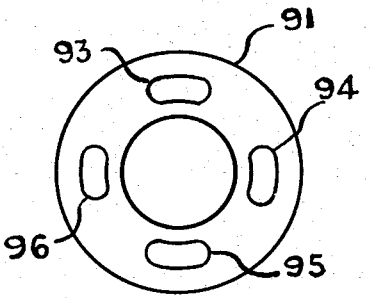
FIGS. 16 and 17 illustrate the control collar utilized by flame tube of FIG. 15.
Figure 17:
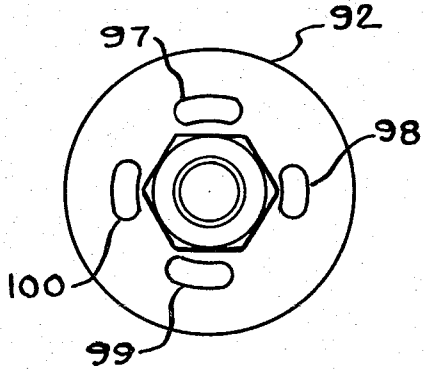

The flame tube 90 shown in FIG. 15 is substantially the same as the flame tube 70, except that the means for controlling the introduction of secondary air into the flame tube provides another embodiment. As shown in FIG. 15, end plates 91 and 92 contain a series of holes 93, 94, 95 and 96 and 97, 98, 99 and 100, respectively (see FIGS. 16 and 17). Plate 91 is rigidly mounted within the flame tube 91 and is not intended to move. Plate 92, however, is designed so as to rotate about the longitudinal axis of the flame tube 90. By rotating plate 92 with respect to plate 91, it is possible to control the size of the secondary air inlet hole.

Holes 93 and 97 correspond to one another as well as 94 and 98; 95 and 99; and 96 and 100. The holes on plate 91 and 92 are exactly the same size and when aligned with one another provide an unrestricted inlet. By rotating plate 92 with respect to plate 91, the holes will no longer be aligned and thus the size of the inlet hole can be restricted.

When the proper mixture of secondary air has been obtained by rotating the end plates with respect to one another, the plate 92 can be secured by a set screw or other fastening means so that it can no longer rotate.

Figure 19:
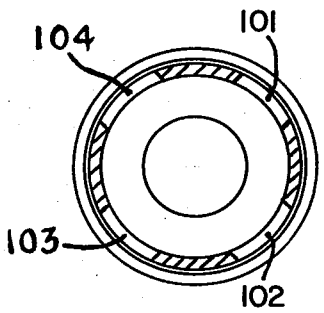
FIG. 19 is a front sectionalized view of the flame tube of FIG. 18.
Figure 18:
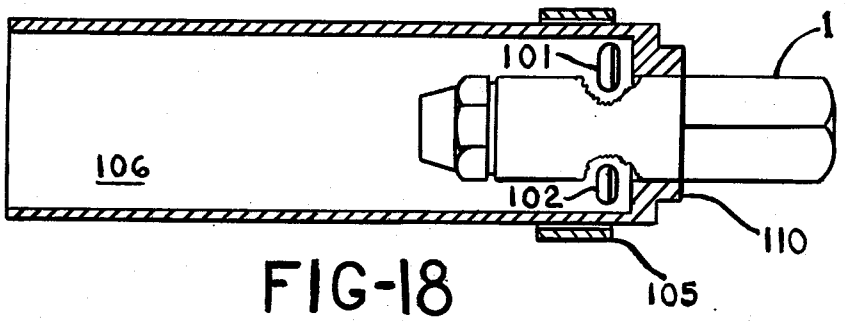
FIG. 18 is a third embodiment of the flame tube and nozzle structure utilized by the present invention.

The flame tube shown in FIGS. 18 and 19 shows an additional embodiment of the invention. The flame tube includes a series of holes 101, 102, 103 and 104 about the rear periphery of the flame tube 106. A collar 105, slidably mounted on the flame tube, is adapted so as to cover a portion of the holes 101 through 104. By controlling the amount by which the holes are covered, the amount of secondary or combustion air that is admitted into the flame tube is also controlled.

Again, when the proper mixture of secondary air is obtained, the collar 105 is then held in place by a set screw or other fastening means so that it cannot move. This embodiment also permits a more easily manufactured mounting block 110 for the nozzle 1. The mounting block 110 is an annular ring which has been designed to accept the nozzle 1. This design also permits the mounting block to be external to the flame tube rather than internal as in the two prior embodiments.

Figure 20:
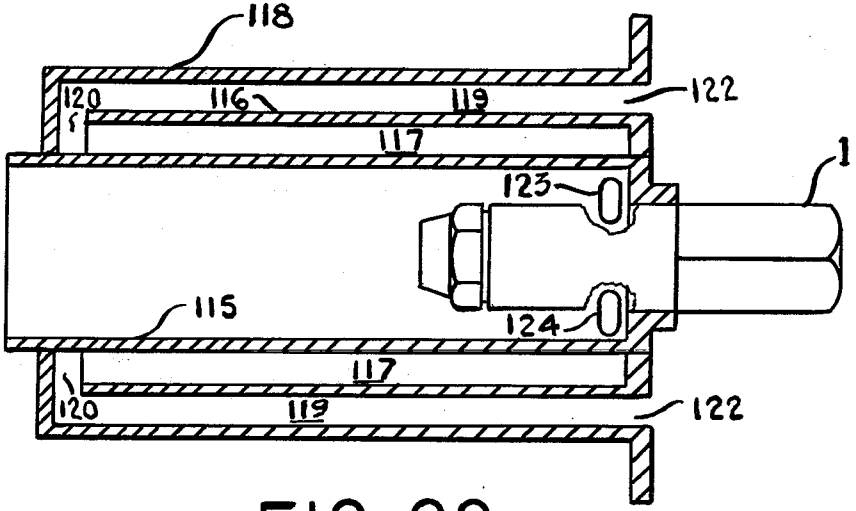
FIG. 20 is an embodiment of the invention which utilizes pre-heated air.

It has been found that a substantial increase in the intensity of the flame produced by the burner of the present invention is obtained by preheating the secondary or combustion air before it is introduced into the flame tube. FIG. 20 discloses an embodiment wherein this is accomplished. The flame tube 115 is substantially the same as the flame tube disclosed in FIGS. 18 and 19. The flame tube is surrounded by a first enclosure 116. Enclosure 116 is cylindrically shaped with a diameter greater than that of the flame tube so as to leave an air space 117 between the enclosure 116 and the flame tube 115. A second enclosure 118 surrounds the first enclosure and has a diameter greater than that of the first enclosure to leave air space 119 between the two. The two enclosures face opposite to one another and are not touching so that there exists a gap 120 between the two enclosures.

Secondary or combustion air enters the burner assembly at orifice 122, passes through air space 119, through gap 120, through air space 117 and into portal 123 and 124 of flame tube 115. When it passes along this circulatory route, it is heated by the hot flame tube which the first and second enclosure encircle. It has been found that flame temperatures in excess of 3500° F. are possible.

It is believed that the construction and operation of the liquid fuel burner, as well as the advantages thereof, will be apparent from the foregoing detailed description. It will also be apparent that while the invention is described in its preferred form, changes may be made without departing from the scope of the invention as sought to be defined in the following claims.

I claim:

1. In a process for the combustion of liquid fuel wherein the liquid fuel is atomized prior to combustion, the improvement therein including carrying out the atomization of the fuel in at least two stages comprising mixing the fuel and atomizing gas such as air within an atomization nozzle to obtain primary atomization, causing the atomized fuel and air mixture to exit the nozzle as an extending conically shaped stream containing fuel droplets, directing a plurality of individual jets of further atomizing air originating at locations which are in a plane which also contains the location where the atomized fuel and air mixture exits the atomization nozzle to converge on the conically shaped atomized fuel stream and intersect therewith downstream of the location where the atomized fuel and air mixture exits the atomization nozzle to obtain secondary atomization causing the fuel droplets therein to be reduced in size the convergence angle of the air jets with the atomized fuel stream, as measured between the axis of the air jets and the longitudinal axis of the conically shaped atomized fuel stream, ranging from 3.5° to 7° and controlling the size of the air jets and the angle and point of convergence of the air jets with the atomized conical stream and the fuel feed in accordance with a predetermined relationship including varying the convergence angle inversely with the fuel feed rate.

2. The improved process for the combustion of liquid fuel as claimed in claim 1 wherein the fuel droplets in the conically shaped atomized fuel stream are of micron size and are reduced to sub-micron size after the secondary atomization.

3. The improved process for the combustion of liquid fuel as claimed in claim 1 further comprising surrounding the atomization nozzle and the primary and secondary atomized fuel stream with a mixing flame tube and controlling the mixing flame tube diameter and length and the location of the nozzle therein with the fuel feed in accordance with a predetermined relationship.

4. The improved process for the combustion of liquid fuel as claimed in claim 1 wherein the jets of further atomizing air are directed to converge on the conically shaped atomized fuel stream symmetrically about its periphery.

5. The improved process for the combustion of liquid fuel as claimed in claims 1, further comprising surrounding the primary and secondary atomized fuel stream with a mixing flame tube and causing combustion air to enter the mixing flame tube and mix with the atomized fuel stream as secondary combustion gas to produce, upon combustion, an extremely intense blue/violet flame having a temperature between 3000°–3200° F. with combustion under near perfect stoichiometric conditions without the formation of soot.

6. The improved process for the combustion of liquid fuel as claimed in claim 5 wherein the combustion gas entering the mixing flame tube comprises approximately 80 percent of the total gas used for combustion of the liquid fuel.

7. The improved process for the combustion of liquid fuel as claimed in claim 5 wherein the secondary combustion gas is preheated before entering the mixing flame tube whereby a flame temperature in excess of 3500° F. is obtainable upon combustion.

8. The improved process for the combustion of liquid fuel as claimed in claim 5 wherein the mixing flame tube is heated as the liquid fuel undergoes combustion and the heat of the mixing flame tube at least partially vaporizes the droplets of fuel in the primary and secondary atomized fuel stream to obtain further, tertiary, atomization.

9. The improved process for the combustion of liquid fuel as claimed in claim 1 wherein the atomizing air for primary atomization and the atomizing air for secondary atomization issue from the same source.

10. The improved process for the combustion of liquid fuel as claimed in claim 9 wherein the atomizing air pressure ranges from 10 to 50 psig.

11. The improved process for the combustion of liquid fuel as claimed in claim 10 wherein the liquid fuel mixed with the atomizing air is at essentially atmospheric pressure.

12. A process for the atomization of liquid fuel prior to combustion thereof comprising feeding liquid fuel oil and above-atmospheric pressure air to an atomization nozzle, causing the air to assume a vortex-like motion, mixing the air and oil to cause the oil to become atomized, causing the air-oil mixture to exit the atomization nozzle as an extending conically shaped stream containing fuel droplets, directing four air jets to converge on the extending conically shaped stream and intersect therewith, the air jets originating in a plane which also passes through the location wherein the air-oil mixture exists the atomization nozzle, the air jets being arranged symmetrically around a circle concentric with the atomization nozzle exit and originating as jets having a defined diameter, the air jets causing further atomization of the air-oil mixture and a reduction in size of the fuel droplets therein, the angle of convergence of the air jets with the conically shaped stream, measured between the axis of the jets and the longitudinal axis of the atomization nozzle and stream exiting therefrom, being related to oil feed rate, jet diameter and point of convergence and intersection, with the stream measured from the plane of the conical stream origination, according to the following relationship:

| Feed Rate, gal/hr | Angle | Jet Diameter Inches | Point Of Intersection Inches |
|---|---|---|---|
| .2 | 7° | .031 | 1 |
| .5 | 4.5° | .031 | 1.22 to 1.5 |
| 1.0 | 3.5° | .035 | 1.66 to 1.75 |

13. In an apparatus for the combustion of liquid fuel including means for mixing an atomizing and combustion gas medium such as air with a liquid fuel such as oil to provide an atomized fuel feed to a combustion chamber, the improvement therein of a mixing nozzle means for mixing the air and the liquid fuel comprising an atomizing area chamber defined by a nozzle front piece having a face, the atomizing area chamber having an exit opening located in the nozzle front piece face communicating with the combustion chamber for providing the atomized fuel thereto, means for feeding liquid fuel to the atomizing area chamber, means for feeding the air to the atomizing area chamber with a vortex-like motion to mix with and atomize the fuel therein, the opening in the atomizing area chamber enabling the mixed air and fuel to exit the nozzle and enter the combustion chamber as an extending conically shaped stream, air ejection means for ejecting a jet stream of atomizing and combustion air into the combustion chamber, the air ejection means comprising at least two passageways located in the nozzle front piece and having openings located in the nozzle front piece face about the periphery of the atomizing chamber opening and in a plane substantially parallel to a plane containing the atomizing chamber opening, the longitudinal axis of the air ejection means forming an angle of 7° or less with the longitudinal axis of the atomizing area chamber and of the conically shaped stream of atomized fuel such that the air jet ejected therefrom converges on and intersects with the atomized fuel stream downstream of the atomizing chamber opening in a manner to cause further atomization thereof.

14. The improved apparatus for the combustion of liquid fuel as claimed in claim 13 wherein the air ejection means passageways and the means for feeding the air medium to the atomizing area chamber communicate with a common air chamber.

15. The improved apparatus for the combustion of liquid fuel as claimed in claim 13 wherein the angle of the air ejection means axis with the conically shaped atomized fuel stream axis varies relative to the fuel feed rate and the air ejection means opening in the front piece face to provide a point of convergence and intersection of the ejected air jet with the atomized fuel stream, measured downstream of the front piece face, according to the following relationship:

| Fuel Feed, gal/hr | Angle | Opening Diameter, Inches | Point of Intersection, Inches |
|---|---|---|---|
| .2 | 7.0° | .031 | 1 |
| .5 | 4.5° | .031 | 1.22–1.5 |
| 1.0 | 3.5° | .035 | 1.66–1.75 |

16. The improved apparatus for the combustion of liquid fuel as claimed in claim 14 further comprising means to provide air to the common air chamber under greater than atmospheric pressure.

17. The improved apparatus for the combustion of liquid fuel as claimed in any of claims 13, 14, 15 or 16 wherein the combustion chamber further comprises a mixing flame tube partially surrounding the mixing nozzle and into which the atomized fuel mixture enters and having means associated with the mixing flame tube for feeding secondary combustion air to the flame tube to mix with the twice atomized fuel.

18. The improved apparatus for the combustion of liquid fuel as claimed in claim 17 wherein the secondary combustion air feed means is an opening located about the periphery of the mixing flame tube upstream of the nozzle front piece face.

19. The improved apparatus for the combustion of liquid fuel as claimed in claim 18 further comprising controlling means for adjusting the size of the mixing flame tube secondary combustion air feed opening.

20. The improved apparatus for the combustion of liquid fuel as claimed in claim 17 wherein the mixing flame tube inside diameter, the mixing flame tube length and the depth of the nozzle front piece face, as measured from the mixing flame tube end upstream of the face, are related to the fuel feed rate as follows:

| Fuel Feed, gal/hr | Tube Diameter, Inches | Tube Length, Inches | Face Depth, Inches |
|---|---|---|---|
| .2 | $1\frac{1}{8}$ | 4 | $2\frac{5}{8}$ |
| .5 | $1\frac{3}{8}$ | 4.43 | $2\frac{5}{8}$ |
| 1.0 | $1\frac{5}{8}$ | 5 | $3\frac{5}{8}$ |

21. The improved apparatus for the combustion of liquid fuel as claimed in claim 19 wherein the combustion air feed opening comprises the open rear end upstream of the flame mixing tube, the controlling means comprises a collar surrounding the mixing nozzle and movable back and front with respect to the mixing flame tube rear end to control an annular opening formed therebetween and the opening, measured as the distance between the collar and the mixing flame tube rear end, is related to the fuel feed rate and the air pressure of the atomizing air in the common chamber as follows:

| Fuel Feed, gal/hr | Distance, Inches | Air Pressure, PSIG |
|---|---|---|
| .2 | 3/32 | 10–20 |
| .5 | 1/16 to 3/32 | 15–30 |
| 1.0 | 3/32 to 5/32 | 50 |

22. An apparatus for the combustion of oil under near perfect stoichiometric conditions without the production of soot and with an extremely intense blue/violet flame having an operating temperature in excess of 3000° F. without the use of pre-heated air comprising a mixing nozzle means for mixing air and oil, a mixing flame tube combustion chamber partially concentrically surrounding the mixing nozzle means, the nozzle means having an atomizing area chamber defined by a nozzle front piece, the atomizing area chamber having an exit opening located in a face of the nozzle front piece and communicating with the mixing flame tube for providing an atomized fuel feed thereto, means for feeding the oil to the atomizing area chamber, means for feeding the air under pressure to the atomizing area chamber with a vortex-like motion to mix with and atomize the oil therein, the opening in the atomizing area chamber enabling the mixed air and oil to exit the nozzle and enter the mixing flame tube as an extending conically shaped stream, air jet ejection means for ejecting a jet stream of air into the flame tube, the air ejection means including passageways in the nozzle front piece having openings located in the face of the nozzle front piece about the periphery of the atomizing chamber opening and concentric thereto, the means for feeding air to the atomizing area chamber and the ejection means passageways communicating with a common air chamber, the longitudinal axis of the air ejection means forming an angle with the longitudinal axis of the atomizing area chamber and of the conically shaped stream of atomized oil such that the air jets ejected therefrom converge on and intersect with the atomized fuel stream in a manner to cause further atomization thereof, the angle varying with the oil feed rate and ranging from 3.5° to 7°, means associated with the mixing flame tube for controllably feeding secondary combustion air to the mixing flame tube to mix with the twice-atomized oil and means for igniting the air-fuel mixture for combustion.

* * * * *